US007004508B1

(12) United States Patent
Flynn et al.

(10) Patent No.: US 7,004,508 B1
(45) Date of Patent: Feb. 28, 2006

(54) FLEXIBLE DRAIN ELEMENT

(76) Inventors: Barbara J. Flynn, 309 Brelsford Ave., Trenton, OH (US) 45067; Marvin L. Flynn, 303 S. Main St., Seven Mile, OH (US) 45062

( * ) Notice: Subject to any disclaimer, the term of this patent is extended or adjusted under 35 U.S.C. 154(b) by 0 days.

(21) Appl. No.: 10/839,868

(22) Filed: May 7, 2004

(51) Int. Cl.
*F16L 43/00* (2006.01)

(52) U.S. Cl. ..... 285/134.1; 285/235; 285/236; 285/135.1; 4/679

(58) Field of Classification Search ..... 285/179, 285/226, 235, 236, 134.1, 135.1; 4/679
See application file for complete search history.

(56) References Cited

U.S. PATENT DOCUMENTS

| | | | | | |
|---|---|---|---|---|---|
| 175,908 | A | * | 4/1876 | Bedell | 137/247.19 |
| 1,329,840 | A | | 2/1920 | Jenkins | |
| 1,450,606 | A | * | 4/1923 | Paine | 277/622 |
| 1,884,855 | A | * | 10/1932 | Pryce | 137/247.51 |
| 2,484,031 | A | * | 10/1949 | Havrenius | 137/247.11 |
| 2,527,270 | A | * | 10/1950 | Levin | 4/312 |
| D231,930 | S | * | 6/1974 | Danks | D23/268 |
| 3,860,978 | A | * | 1/1975 | Wirth | 4/679 |
| 3,908,208 | A | * | 9/1975 | McIlroy | 4/679 |
| 3,967,324 | A | * | 7/1976 | Olive | 4/679 |
| 4,081,190 | A | * | 3/1978 | Itzler | 285/226 |
| 4,165,110 | A | * | 8/1979 | Itzler | 285/226 |
| 4,516,278 | A | | 5/1985 | Lamond | |
| 4,846,510 | A | * | 7/1989 | Mikol | 285/226 |
| 5,063,616 | A | * | 11/1991 | Bresnahan | 137/247.49 |
| 5,341,523 | A | | 8/1994 | Barnes | |
| 5,427,417 | A | | 6/1995 | Lechuga | |
| 5,775,736 | A | | 7/1998 | Svetlik | |
| D437,633 | S | | 2/2001 | Weise et al. | |
| D453,553 | S | | 2/2002 | Maerz | |
| 6,543,470 | B1 | * | 4/2003 | Mans | 137/247.19 |
| 6,594,849 | B1 | | 7/2003 | Nimens | |

* cited by examiner

*Primary Examiner*—James M. Hewitt
(74) *Attorney, Agent, or Firm*—Donald R. Schoonover

(57) ABSTRACT

A flexible drain element is used in place of a trap and has a section that is flexible with a stiffness that is selected to make clearing blockages easy and expeditious.

2 Claims, 1 Drawing Sheet

FLEXIBLE DRAIN ELEMENT

BACKGROUND OF THE INVENTION

1. Field of the Invention

The present invention relates to the general art of plumbing, and to the particular field of plumbing drains.

2. Discussion of the Related Art

All sinks, baths and toilets have some sort of plumbing connection to a drain system. This plumbing system generally includes a trap, which is a U-shaped portion of the fluid conduit connecting the sink, etc., to the drain system. The trap serves several purposes.

Blockages often occur in the trap. These blockages must be cleared using a force cup, or a snake, or chemicals. These methods may be time consuming and costly.

Therefore, there is a need for a drain element that can be easily cleared of blockages.

Some buildings have numerous sinks, baths, and toilets. Therefore, it could be extremely costly and time consuming to change all the drain systems in such buildings. Any savings in cost and/or time in performing a change in a plumbing system would be beneficial, especially if there are numerous sinks, etc., such as might be found in a hotel or the like.

Therefore, there is a need for a drain element that is easily installed.

Still further, some plumbing systems are different from others, even within the same building. This occurs for sinks versus baths, etc.

Therefore, there is a need for a drain element that is easily sized to fit a plumbing installation.

PRINCIPAL OBJECTS OF THE INVENTION

It is a main object of the present invention to provide a drain element that can be easily cleared of blockages.

It is another object of the present invention to provide a drain element that is easily installed.

It is another object of the present invention to provide a drain element that is easily sized to fit a plumbing installation.

SUMMARY OF THE INVENTION

These, and other, objects are achieved by a flexible drain element that has two ends and a flexible section which has a stiffness which is less than the stiffness of the drain element adjacent to either end of the drain element.

Using the drain element embodying the present invention will permit a user to easily clear any blockage from the drain and will prevent the blockage from backing up against the clearing effort. A user can slide his or her hand along the drain element in the direction of flow to help move any blockage out of the drain element or to aspirate the drain. However, the drain element of the present invention is still easy to install and will be securely held in place on the fluid conduits of the plumbing system.

BRIEF DESCRIPTION OF THE DRAWING FIGURES

DETAILED DESCRIPTION OF THE PREFERRED EMBODIMENT

Figure 3:
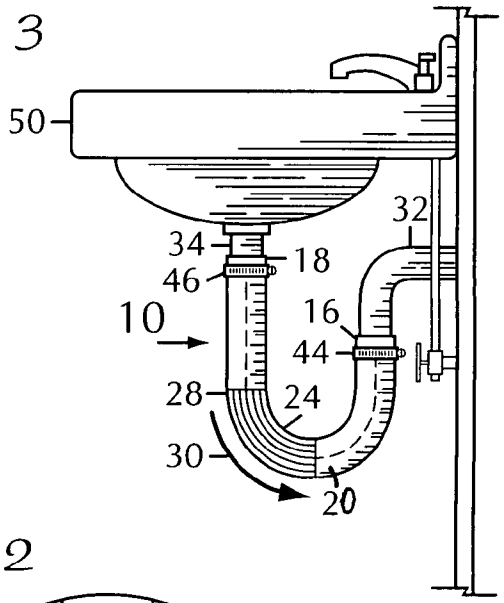
FIG. 3 shows the plumbing drain in place in a sink drain system, according to the present invention.
Figure 2:
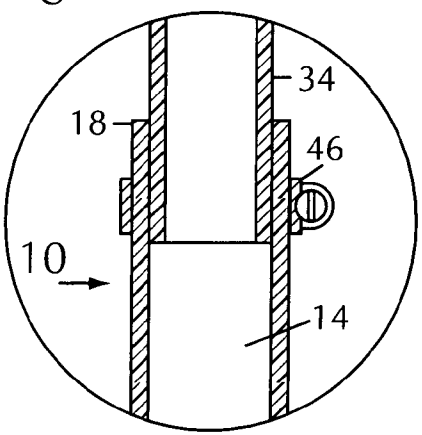
FIG. 2 is a sectional view taken along line 2—2 of FIG. 1.
Figure 1:
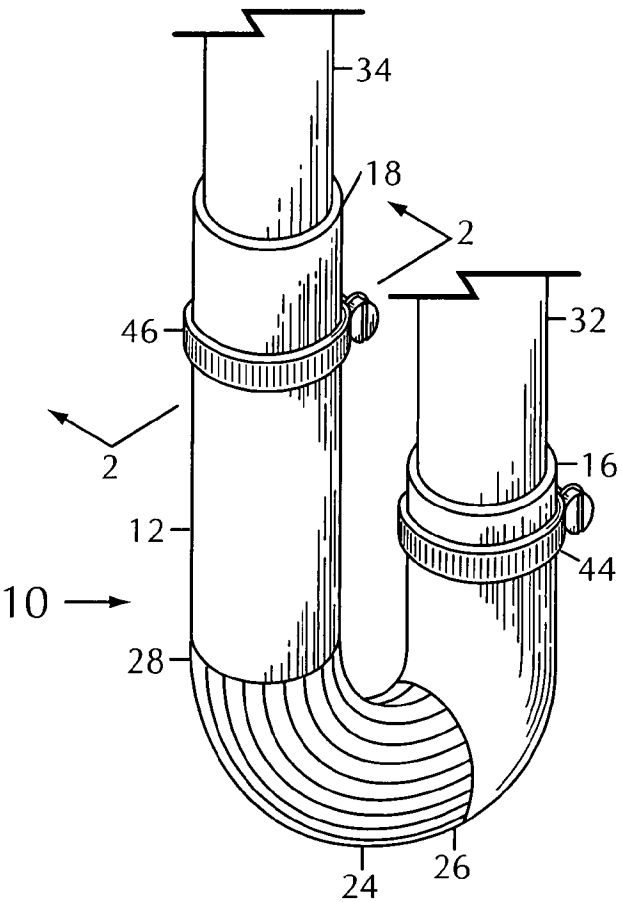
FIG. 1 is a perspective view of a plumbing drain embodying the present invention.

Other objects, features and advantages of the invention will become apparent from a consideration of the following detailed description and the accompanying drawings.

Referring to the Figures, it can be understood that the present invention is embodied in a flexible drain element 10. Drain element 10 can be used in connection with a sink, a bathtub, a toilet, or the like.

Element 10 includes a hollow tubular one-piece body 12 which can be formed of rubber or other suitably flexible material that will not be damaged by chemicals commonly used in the plumbing system associated with element 10.

Body 12 of element 10 is hollow and has a central bore 14, a distal end 16, a proximal end 18, and a central axis 20 which extends between the distal end 16 and the proximal end 18. Body 12 has a first stiffness adjacent to the distal end 16 and a second stiffness adjacent to the proximal end 18. The stiffness of the body 12 adjacent to either end 16, 18 can be the same or different as suitable.

One-piece body 12 includes a section 24 which has a first end 26 located near and spaced apart from the distal end 16 and a second end 28 that is located near and spaced apart from the proximal end 18 of the body 12. Section 24 is formed to be flexible and to have a stiffness that is less than either the stiffness of the body 12 adjacent to distal end 16 or the stiffness of the body 12 adjacent to proximal end 18. In one form of the element 10, section 24 is formed to be stiffer adjacent to the distal end 16 than adjacent to the proximal end 18 with the stiffness of section 24 of the one-piece body 12 increasing in a flow direction from the proximal end 18 to the distal end 16 as indicated by arrow 30. The distal and proximal ends 16, 18 of the body 12 are flexible but need not change in stiffness along the central axis 20 of the body 12, and are flexible enough to tightly fit pipes 32 and 34 of the plumbing system. The varying stiffness of section 24 permits the body 12 to be easily manipulated during installation or removal, but will also permit a blockage to be easily cleared from element 10.

In one form of the invention, the stiffness of body 12 between second end 28 and proximal end 18 is uniform and equal to the stiffness of section 24 at second end 28, and the stiffness of body 12 between first end 26 and distal end 16 is uniform and equal to the stiffness of section 24 at first end 26. It is noted that "stiffness" of a tubular body can be measured using techniques known to those skilled in the art and thus will not be discussed. The particular method and scales used to measure stiffness of a tube do not form part of the present invention.

A first screw-operated clamp 44 surrounds the body 12 adjacent to the distal end 16 of the body 12 and clamps the body 12 to pipe 32, while a second screw-operated clamp 46 surrounds the body 12 adjacent to the proximal end 18 of the body 12 to attach the body to pipe 34.

Element 10 is shown in combination with a wall-mounted sink 50 in FIG. 3; however, element 10 can be used in any suitable plumbing system and no limitation to sinks is intended by the disclosure in FIG. 3.

It is understood that while certain forms of the present invention have been illustrated and described herein, it is not to be limited to the specific forms or arrangements of parts described and shown.

The invention claimed is:

1. A flexible drain element comprising:

a) a hollow tubular one-piece body having (1) a distal end, (2) a proximal end, and (3) a central axis extending between the distal end and the proximal end;

b) a section of said one-piece body which includes (1) a first end located near and spaced apart from the distal end, (2) a second end located near and spaced apart from the proximal end, (3) said section being stiffer adjacent to the first end than adjacent to the second end with the stiffness of said section of said one-piece body increasing in a flow direction of fluid flowing through said one-piece body from the proximal end to the distal end;

c) said body having a first uniform stiffness between the distal end and the first end of said section, with the first stiffness being equal to the stiffness of said section adjacent to the first end;

d) said body having a second uniform stiffness between the proximal end and the second end of said section, with the second stiffness being equal to the stiffness of said section adjacent to the second end;

e) a first clamp surrounding said body adjacent to the distal end of said body; and f) a second clamp surrounding said body adjacent to the proximal end of said body.

2. A flexible drain element comprising:

a) a hollow tubular one-piece body having (1) a distal end, (2) a proximal end, and (3) a central axis extending between the distal end and the proximal end;

b) a section of said one-piece body which includes (1) a first end located near and spaced apart from the distal end, (2) a second end located near and spaced apart from the proximal end, (3) said section being stiffer adjacent to the first end than adjacent to the second end with the stiffness of said section of said one-piece body increasing in a flow direction of fluid flowing through said one-piece body from the proximal end to the distal end; and c) said body having a first uniform stiffness between the distal end and the first end of said section, with the first stiffness being equal to the stiffness of said section adjacent to the first end;

d) said body having a second uniform stiffness between the proximal end and the second end of said section, with the second stiffness being equal to the stiffness of said section adjacent to the second end.

* * * * *